United States Patent [19]

Suzuki et al.

[11] Patent Number: 4,847,981

[45] Date of Patent: Jul. 18, 1989

[54] METHOD FOR PRODUCING A DIAPHRAGM FOR ACOUSTIC APPLIANCES

[75] Inventors: Kunio Suzuki; Toshiharu Hoshi, both of Hamamatsu, Japan

[73] Assignee: Yamaha Corporation, Japan

[21] Appl. No.: 184,386

[22] Filed: Apr. 21, 1988

[30] Foreign Application Priority Data

Apr. 30, 1987 [JP] Japan ..... 62-108280

[51] Int. Cl.[4] ..... H04R 31/00

[52] U.S. Cl. ..... 29/594; 29/527.2; 181/167; 423/445; 423/448; 423/458

[58] Field of Search ..... 29/527.2, 594, 609.1; 181/157, 166, 296; 264/29.1; 423/458, 448, 445

[56] References Cited

U.S. PATENT DOCUMENTS 4,395,814 8/1983 Tsukagushi et al. ..... 29/594

FOREIGN PATENT DOCUMENTS 36498 2/1984 Japan ..... 29/594

161099 7/1986 Japan ..... 29/594

*Primary Examiner*—Timothy V. Eley

*Attorney, Agent, or Firm*—Lerner, David, Littenberg, Krumholz & Mentlik

[57] ABSTRACT

In production of a diaphragm for acoustic appliances, a thin metal layer is formed on a substrate by means of vapor phase development so that the density of the product should be high enough for generating high sound pressure even in the high frequency range.

7 Claims, 3 Drawing Sheets

METHOD FOR PRODUCING A DIAPHRAGM FOR ACOUSTIC APPLIANCES

BACKGROUND OF THE INVENTION

The present invention relates to an improved method for producing a diaphragm for acoustic appliances, and more particularly relates to an improvement in production of a diaphragm used for acoustic appliances such as speakers and microphones.

Method for producing such a diaphragm are proposed, for example, in Japanese Patent Opening No. Sho. 49-129640 and Japanese Patent Publication No. Sho. 53-4421.

The process proposed in JPO. No. Sho. 49-129640 is directed to production of a beryllium thin plate. The process includes the step of developing a thin beryllium layer of a prescribed thickness on a substrate by means of vacuum evaporation and the step of removing the substrate via dissolution. In the case of this conventional process, the diaphragm obtained is low in density due to the inherent fragility of beryllium and, in particular, evolvement of fine voids. As a consequence, the diaphragm is unable to generate sufficient sound pressure in the high frequency range when used for speakers.

In the process of JPP. No. Sho. 53-4421, a thin beryllium alloy layer containing 0.1 to 15% of aluminum is developed on a substrate and, after heat treatment, the alloy thin layer is separated from the substrate. The heat treatment is carried out, for example, in an argon gas environment at 600° C. to 650° C. for about one hour. In this case, increase in density of the product via the heat treatment has a limit and the resultant density of the product is still insufficient for use as a diaphragm for acoustic appliances. Like the first example, the diaphragm is again unable to generate sufficient sound pressure in the high frequency range.

SUMMARY OF THE INVENTION

It is thus the basic object of the present invention to enable production of a diaphragm which can generate sufficiently high sound pressure even in the high frequency range when used for acoustic appliances.

In accordance with the basic aspect of the present invention, a thin metal layer is developed on a substrate by means of vapor phase development or vapor growth and the thin metal layer is treated under a high temperature and pressure condition.

DESCRIPTION OF THE PREFERRED EMBODIMENTS

As briefly stated above, the present invention is characterized by development of a thin metal layer by means of vapor phase development or vapor growth followed by high temperature and pressure treatment.

The vapor phase development is given in the form of vacuum evaporation, sputtering, ion plating and/or vapor phase decomposition reaction. The middle product by the vapor phase development is still low in density due to presence of fine voids. In order to remove such voids, the middle product is then subjected to the high temperature and pressure treatment after removal of the substrate via separation or dissolution.

Thanks to the application of such an additional treatment under high temperature and pressure conditions, the end product is provided with a density high enough for generating high sound pressure even in the high frequency range. In other words, the employable high frequency range can be enlarged.

When the melting point of the material used for the thin metal layer is equal to Tm, the treatment should preferably be carried out at the following temperature (T°C.) and pressure (PMPa);

$0.35\ Tm \leqq T < Tm$ $20 \leqq P$

When beryllium is used for the thin metal layer, its melting point is equal to 1285° C. and the preferable temperature should be in a range from about 450° to about 1285° C. When titanium is used for the thin metal layer, its melting point is equal to 1680° C. and the preferable temperature should be in a range from about 590° to about 1680° C.

Figure 6:
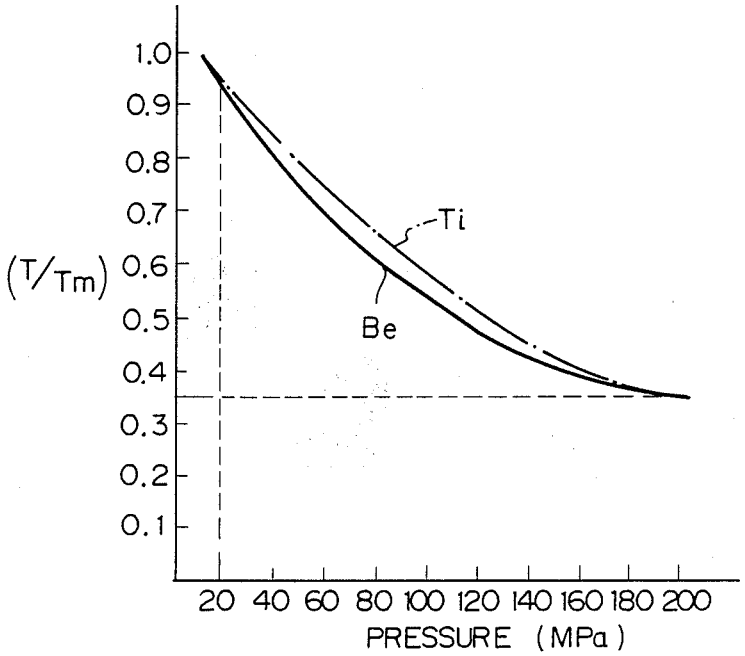
FIG. 6 is a graph for showing the relation between the processing temperature and the processing pressure for providing the product with a specified sound pressure.

The upper limit of the employable temperature should be lower than the melting point of the employed material in order to prevent dissolution of the material during the treatment. Choice of the lower limit for the employable temperature is based on the relation between the temperature and the processing pressure. That is, as is clear from FIG. 6, 0.5 dB increase in sound pressure is observed at 10 KHz frequency and the processing pressure at this point exceeds 200 MPa which is too high to be employed. More preferably, the temperature T should be 0.55 Tm or higher. In this temperature range, 0.5 dB increase in sound pressure can be easily obtained at 100 MPa pressure.

Choice of the lower limit for the employable pressure is based on the fact that, when the pressure is 20 MPa or higher, 0.5 dB increase in sound pressure is observed at a temperature of 0.95 Tm.

The high temperature and pressure can be carried out by a hot press device too.

Beryllium, beryllium alloys, titanium and titanium alloys are preferably used for the thin metal layer.

Figure 1:
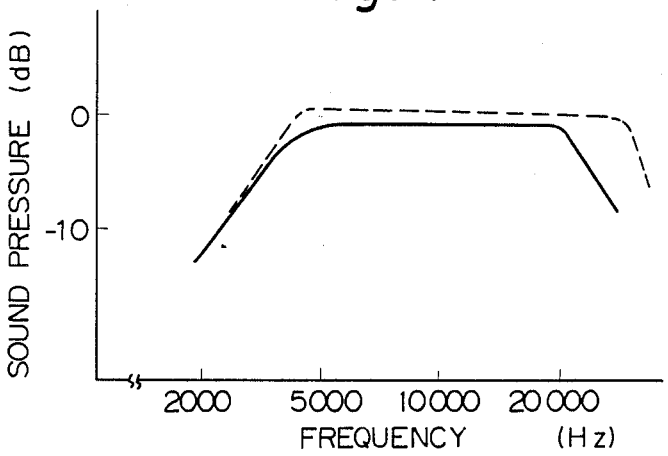
FIG. 1 is a graph for showing relations between the frequency and the sound pressure of a diaphragm.
Figure 2:
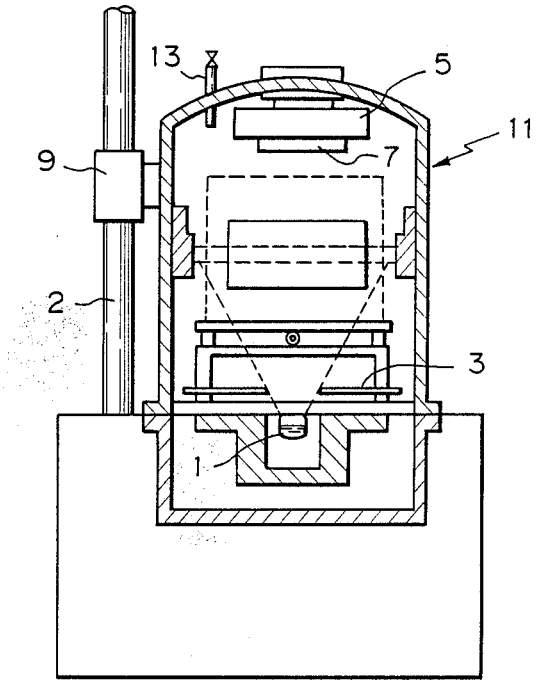
FIG. 2 is a front view, partly in section, of an arrangement for practicing one embodiment of the present invention.
Figure 3:
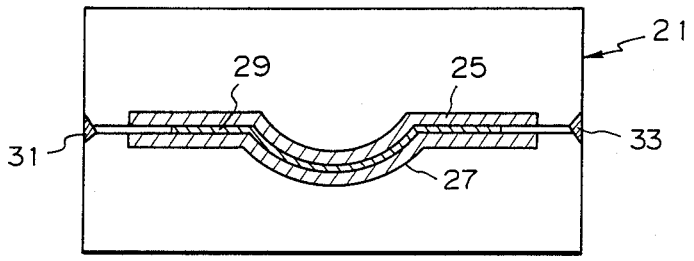
FIG. 3 is a sectional view of a container used for production of a diaphragm in accordance with one embodiment of the present invention.

One embodiment of the present invention is now explained in reference to FIGS. 1 to 3.

FIG. 1 depicts the relation between the frequency and the sound pressure of different diaphragms, the solid line being for a diaphragm produced by the conventional method and the dot line being for a diaphragm produced by the method in accordance with the present invention. In the high frequency region, for example in a region of 2000 Hz or higher, a clear rise in sound pressure by employment of the present invention is observed, beryllium being used for the thin metal layer.

The arrangement shown in FIG. 2 is used for vapor phase development in accordance with the present invention. More specifically, a vacuum container 11 is vertically movably mounted to an upright post 2 via a lifter unit 9 and a support plate 5 is attached to the ceiling of the vacuum container 11 for mounting of a substrate 7. An evaporation source 1 is arranged at the bottom of the vacuum container 11 and a pressure differential plate 3 is arranged just above the evaporation source 1. A gas inlet 13 is arranged at the top of the vacuum container 11.

In the operation, the inside of the vacuum container 11 is first evacuated and the face of the preheated substrate 7 is cleaned. Under this condition argon gas is introduced via the inlet 13 into the vacuum container 11 in order to cause glow discharge at a negative voltage on the substrate 7. Argon atoms are ionized in the plasma medium and ion striking is started against the face of the substrate 7. As a result of this clean spattering, the crystal structure on the face of the substrate is cleaned for smooth bonding of the layer to be generated. Next, the electron gun starts to operate and the metallic material in the source 1 starts to evaporate at the boiling point under the reduced pressure. The evaporated metallic material is then ionized in the plasma medium to strike the face of the substrate 7 and the reaction gas next introduced is also ionized. The ionized reaction gas causes chemical reaction with the thin layer of the material developed on the face of the substrate 7 to form a composition, thereby a crystal thin metal layer being developed on the face of the substrate 7.

Next, the thin metal layer so obtained is subjected to the treatment under a high temperature and pressure condition in an arrangement (hot hydrostatic device) shown in FIG. 3. For this treatment, an iron container 21 separable into two pieces is used and mating faces of the places are covered with ceramic coatings 25 and 27. The thin metal layer 19 developed in the foregoing process is sandwiched between the ceramic walls 25 and 27 of the container 21 and the two pieces are welded together along their peripheries 31 and 33.

Next, the container 21 is placed in a furnace filled with argon gas and left, for example, one hour at 1050° C. and 150 MPa. The ceramic coatings 25 and 27 are provided in the container 21 in order to prevent mutual diffusion between beryllium and iron and the pieces are welded together in order to prevent contact of the thin metal layer with the argon gas. Heating is effected via the medium, i.e. the argon gas filled in the furnace.

Another embodiment of the present invention will now be explained in reference to FIGS. 4 and 5. In this case, a hot press device such as shown in FIG. 5 is used as a substitute for the device shown in FIG. 3. More specifically, the device includes a pair of mould pieces 41 and 43 made of, for example, graphite which are separably held by holders 47 and 49 and the mould pieces 41 and 43 are surrounded by a heater coil 51. Like the foregoing embodiment, mating faces of the mould pieces 41 and 43 are covered with ceramic coatings. The thin metal layer 45 in this embodiment is made of, for example, titanium by means of the vapor phase development. After sandwiching the thin metal layer 45 between the mould pieces 41 and 43, the treatment is carried out for one hour at 1100° C. and 50 MPa.

Figure 4:
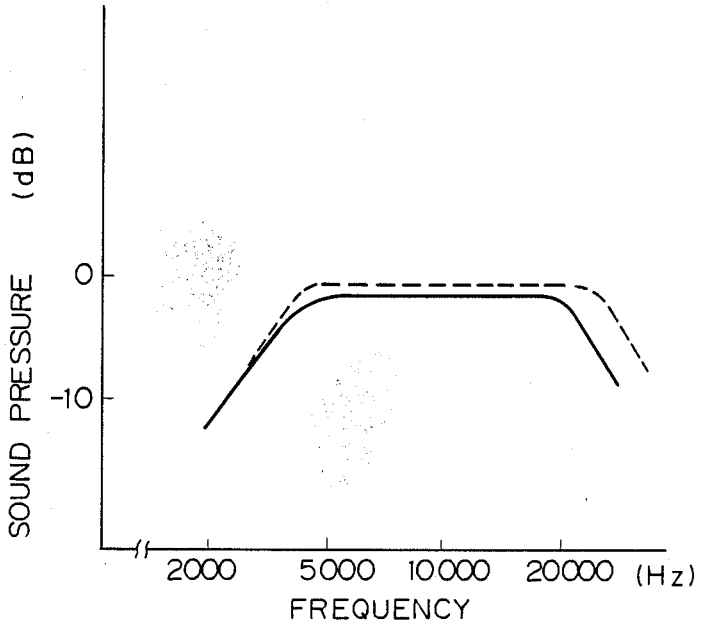
FIG. 4 is a graph for showing the relation between the frequency and the sound pressure of a diaphragm produced in accordance with another embodiment of the present invention.
Figure 5:
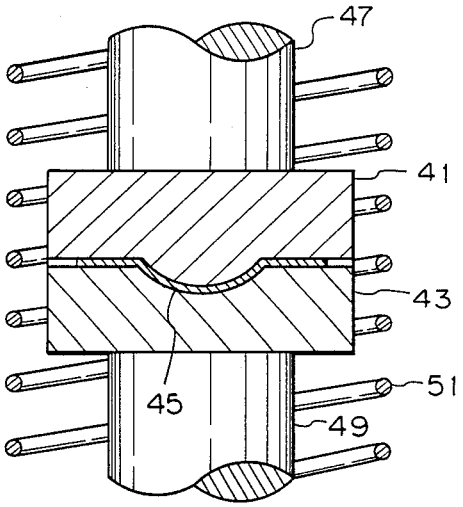
FIG. 5 is a front view, partly in section, of an arrangement for practicing another embodiment of the present invention.

The result is shown in FIG. 4, in which the solid line is for a diaphragm produced by the conventional method and the dot line is for a diaphragm produced by the method in accordance with the present invention. In the high frequency range, for example in a frequency range of 2000 Hz or higher, the sound pressure is clearly raised by employment of the present invention.

We claim:

1. An improved method for producing a diaphragm for acoustic appliances comprising the steps of developing a thin metal layer on a substrate by means of vapor phase development, and increasing the density of said thin metal layer by exposing said layer to an elevated temperature and an elevated pressure.

2. An improved method as claimed in claim 1 wherein said increasing of the density of said thin metal layer is carried out on a hot press device.

3. An improved method as claimed in claim 1 wherein said increasing of the density of said thin metal layer is carried out on a hot hydrostatic device.

4. An improved method as claimed in claim 1 in which a material for said thin metal layer is chosen from a group consisting of beryllium, beryllium alloys, titanium and titanium alloys.

5. An improved method as claimed in claim 1 wherein said elevated temperature is between about 0.35 Tm and about Tm, Tm being the melting point of a material used for said thin metal layer.

6. An improved method as claimed in claim 1 wherein said elevated pressure is at least about 20 MPa.

7. A diaphragm for acoustic appliances produced by the method according to claim 1.

* * * * *